US006891125B2

(12) United States Patent
Mühlenbach

(10) Patent No.: US 6,891,125 B2
(45) Date of Patent: May 10, 2005

(54) DECANTING SYSTEM AND METHOD OF USE FOR A PRODUCT MADE OF VISCOUS MATERIAL

(75) Inventor: Ulrich Mühlenbach, Sasbach (DE)

(73) Assignee: UHU GmbH & Co. KG, Buhl (DE)

( * ) Notice: Subject to any disclaimer, the term of this patent is extended or adjusted under 35 U.S.C. 154(b) by 46 days.

(21) Appl. No.: 10/465,469

(22) Filed: Jun. 19, 2003

(65) Prior Publication Data

US 2004/0017026 A1 Jan. 29, 2004

(30) Foreign Application Priority Data

Jul. 24, 2002 (DE) ..... 102 33 662

(51) Int. Cl.[7] ..... B23K 26/38
(52) U.S. Cl. ..... 219/121.67; 219/121.72
(58) Field of Search ..... 219/121.6, 121.61, 219/121.69, 121.67, 121.72

(56) References Cited

U.S. PATENT DOCUMENTS 4,226,266 A * 10/1980 Guigan ..... 141/11
5,197,633 A * 3/1993 Hines et al. ..... 222/14
5,285,750 A * 2/1994 Molian et al. ..... 119/174
6,229,114 B1 * 5/2001 Andrews et al. ..... 219/121.72
6,388,231 B1 * 5/2002 Andrews ..... 219/121.69

FOREIGN PATENT DOCUMENTS

| | | |
|---|---|---|
| DE | 3904287 A1 | 9/1989 |
| DE | 92 08 679.9 U1 | 9/1992 |
| DE | 92 17 784.0 U1 | 4/1993 |
| WO | WO 94/13451 | 6/1994 |

* cited by examiner

*Primary Examiner*—Geoffrey S. Evans
(74) *Attorney, Agent, or Firm*—Quarles & Brady LLP

(57) ABSTRACT

A decanting system and method of use for a product made of viscous material, particularly a chemicotechnical substance that is discharged from a portioning deuce (10,11) in the form of a product string (12) and cut into its final portions includes a device to cut through the product string (12). The cutting device includes a laser whose beam (15) is directed transversely to the product discharge direction and passes through the product string (12) in order to cut it into portions.

10 Claims, 1 Drawing Sheet

DECANTING SYSTEM AND METHOD OF USE FOR A PRODUCT MADE OF VISCOUS MATERIAL

CROSS REFERENCES TO RELATED APPLICATIONS

Not Applicable

STATEMENT REGARDING FEDERALLY SPONSORED RESEARCH

Not Applicable.

FIELD OF THE INVENTION

The invention involves a decanting system for a product made of viscous material, particularly a chemicotechnical substance, that is discharged in the form of a string from a portioning device and cut into its final portions by means of a device that cuts through the product string.

The term "chemicotechnical substance" refers primarily to any viscous product, particularly one that is produced by chemotechnical methods, which in its liquid form is discharged in the form of a string from a portioning device by means of a filling machine. This product string is cut through or divided into its final portions by means of a special device. In particular, the present invention concerns the cutting device of the system under discussion, which has so far been produced in various ways, as will be explained in greater detail below.

BACKGROUND OF THE INVENTION

Regardless of the decanting principle used for the viscous substance, including e.g. piston dosage, membrane technology, pressure-dependent, time-regulated dosage for a prespecified pressure chamber characteristic, inductive discharge measurement, weight dosage in a storage container placed on weighing meters, and similar techniques, the decanted material (also primarily described as viscous material) may be cut between a filling mechanism (also primarily described as a portioning device) and a decanting container. This cutting of the decanted material has traditionally been achieved e.g. by means of a cylindrical filling pipe with a valve face at its exit point.

This filling pipe is sealed by means of a slide acting as a counterpart either in the outflow direction or conversely at the end of a dosage operation, thus cutting the decanted material. An alternative cutting technique is known in the form of the rotary disk principle, in which a rotating valve plug seals the dosage path, and vice versa. The adhesion/cohesion between the filling pipe and the product is also suitable for cutting the decanted material, which obviates the need for cutting the material after the end of the dosage stroke. This known principle can be supported by blowing the material free with air or inert gas. As an alternative, gravity can be used to achieve a reproducible emptying of the filling pipe.

Rotating circular blades or special blade sections, which are moved transversely to the flow direction of the decanted material, could also be used as cutting devices for the decanting equipment under discussion.

Independent of the aforementioned cutting principles, essential prerequisites for the cutting operation are that it is reproducible, that the cutting occurs without subsequent droplet formation, that no product threads are created, and that the cut portions siphon cleanly back into the filling pipe or the decanting container in order to ensure that the container is filled to the rim as desired. These conditions can be fulfilled by almost all of the aforementioned cutting devices, at least for low decanting speeds and low-viscosity material. The problem arises when larger cycle times are required and/or the decanted material has a higher viscosity. Particularly in the case of highly viscous material, the generation of product threads cannot be ensured by the traditional cutting devices.

A decanting system of the type initially described is known from DE 92 08 679 U1 or DE 92 17 784 U1. These known decanting systems each use mechanical devices to cut through the product string, with the devices arranged between the portioning device in the form of a filling pipe and a decanting container.

WO 94/13451 A1 describes a technique whereby cooled and coagulated hotmelt packages are cut using a laser. DE 39 04 287 A1 describes a device for cutting fluid-containing materials by means of a laser.

SUMMARY OF THE INVENTION

A general objective of the present invention is to create a decanting system of the type initially described which also ensures a clean final portioning of critical material, particularly one that is free of product threads, and which also permits a higher cycle rate then has been possible thus far based upon the cutting device. This objective is achieved by cutting the product threads using a laser that transversely cuts the thread.

Advantageously, the decanting system according to the invention can be advantageously used to decant portions of adhesive into containers, with the adhesive being poured into the containers in liquid form for final position portioning. The decanting system according to the invention is similarly suitable for use with adhesives that consist of a watery/easily flowing to moderately viscous substance, as well as for adhesives consisting of a thicker, gel-like substance of semi-solid consistency.

This and still other objects and advantages of the present invention will be apparent from the description which follows. In the detailed description below, a preferred embodiment of the invention is described in reference to the accompanying drawing. This embodiment does not represent the full scope of the invention. Rather the invention may be employed in other embodiments. Reference should therefore be made to the claims herein for interpreting the breadth of the invention.

BRIEF DESCRIPTION OF THE DRAWINGS

The invention is explained in greater detail below using an example based upon the following figure.

DETAILED DESCRIPTION OF THE INVENTION

Figure 1:
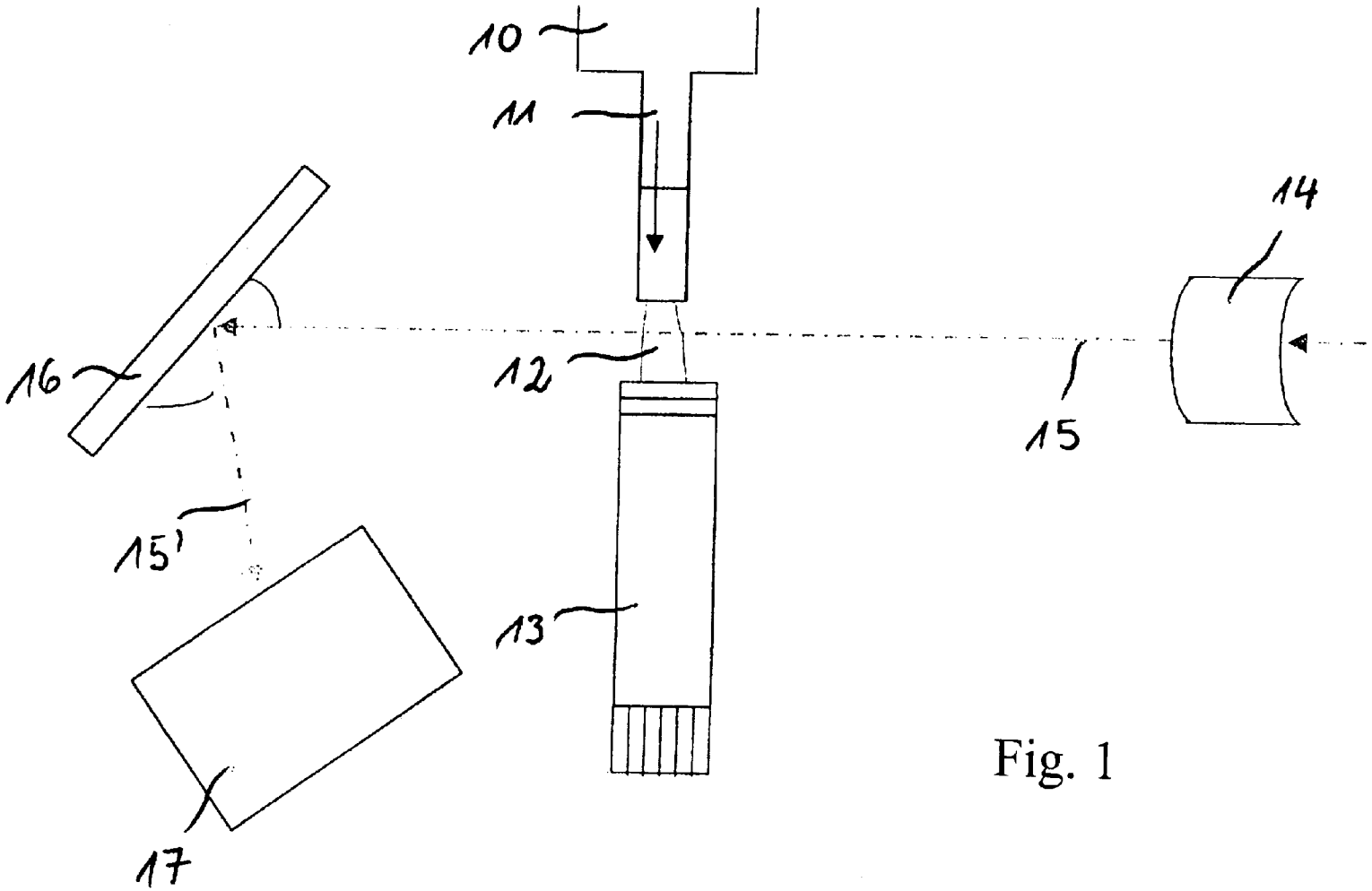
FIG. 1 shows a schematic of an embodiment of the decanting system according to the invention in the area of the laser cutting device.

In contrast to current cutting devices, the present invention proposes the use of a laser beam to cut the product string in the decanting system under discussion. Surprisingly, it has been shown that the use of a laser beam for the desired purpose not only fulfills the initially described requirements for the decanting system's cutting device, including production that is free of product threads, but also that the cutting device, which works in a contact-free manner on the basis of a laser according to the invention, permits significantly higher cycle rates than existing cutting devices. The laser to be used could be any laser that provides the necessary energy density. A $CO_2$ laser, however, is a preferred laser for the decanting system according to the invention.

This special capability of the cutting device in the decanting system according to the invention is surprising because the current prejudice among specialists is that a laser with the relatively high energy density required for such a task could not be used to cut through viscous product material, particularly the product string of a chemicotechnical substance, because this would result in carbonization of the material. No such carbonization could be found in the present case, however, particularly not in conjunction with the decanting of adhesive substances. There is as yet no definitive explanation for this. It is assumed, however, that this behavior of the laser cutting device is based upon the fact that the product's water content produces a vaporization of the aqueous phase (which, in addition to water, can also contain vapor-pressure-dependent portions of the remaining substance contents) around the laser beam that is cutting through the product string, and that this vaporization is associated with a limitation of the temperature. In other words, when the product string is cut through using the laser beam, a water vapor buffer of a sort forms around the laser beam. This buffer contributes to a limitation of the temperature during the laser cutting operation, which protects the substance contents from heat sufficiently to prevent carbonization.

Advantageously, the laser cutting device provides many advantages. Because of the high-energy laser beam, the contact time with the product string can be reduced. The cutting temperature is reduced by the aforementioned effect of the water vapor buffer such that the chemical composition of the substance is not impaired by the laser beam. The contact-free laser cutting operation eliminates mechanical wear caused by the cutting operation. The laser cutting according to the invention also ensures improved hygiene, requires less cleaning, and results in improved efficacy.

The laser cutting device according to the invention has proven to be particularly advantageous when working with moderately viscous chemicotechnical substances that tend to create threads, because the laser completely prevents the creation of threads. Because of this advantage, the laser cutting device according to the invention is particularly well-suited for materials that are difficult to decant.

In an advantageous improvement of the invention, the product string is cut through by a relative movement between the laser beam and the product string from one side to the other of the product string which can have any given cross-section shape. In one embodiment of the invention, this relative movement between the laser beam and the product string is provided by a stationary laser beam that is continuously emitted, with the product string in this case being moved through the laser beam. As an alternative, the laser beam can be moved transversely through the product string. In yet another alternative, the laser beam for cutting through the product string can be discontinuously directed at the product string, which ensures that the laser beam strikes the product string only when the string is to be cut.

An advantageous improvement of the invention provides that the energy density of the laser beam and its contact time with the product string are adjusted based upon the material and strength of the product string such that the string is cut through without creating threads and/or subsequent droplets and/or with cleanly cut portions.

In a preferred embodiment shown in FIG. 1, the decanting system consists of a dosage container 10, joined on its base by a filling pipe 11, which is connected with the dosage chamber 10 and which typically has a diameter of between 3 and 50 mm. By means of a piston action that is not described in greater detail, the product to be discharged, particularly a chemicotechnical substance, is fed from the dosage container 10 into the filling pipe 11, as indicated by an arrow, and in the course of the further piston stroke is discharged from the filling pipe as a product string 12. Following its exit from the filling pipe 11, the profile of the product string 12 is not round in accordance with the round cross-section of the filling pipe, but instead changes depending, among other things, on its distance from the object to be filled, in this case a cylindrical receiving container 13 for the product, which is placed below the filling pipe 11 coaxial to the pipe's longitudinal axis. The distance between the lower end of the filling pipe 11 and the upper end of the container 13 is typically between 1 and 50 mm.

In order to transversely cut through the product string 12 in accordance with the aforementioned requirements, the invention provides for a cutting device in the form of a laser, such as a CO2 laser, which generates a laser beam. As is known in the art of laser beam generators, the laser beam is decoupled with the help of an output mirror 14 and directed transversely through the product string 12. After the laser beam 15 has passed through the product string 12, it hits a mirror 16, which redirects the laser beam by a prespecified angle (laser beam section 15'). Following the redirection, the laser beam (laser beam section 15') hits a radiation trap 17, in which the laser energy is dissipated with the help of cooling water passing through the radiation trap 17 and used as heat energy if desired.

According to the invention, the energy density of the laser beam 15 and its contact time with the product string 12 are adjusted based upon the material and strength of the product string 12 is such a way that the product string 12 is cut through without creating threads 10 or subsequent droplets and with cleanly cut portions (i.e. not jagged portions), so that the product material siphons cleanly back into the container 13 after being cut through, so that the container can be filled to the rim without difficulty.

It is preferable that the laser beam 15 and product string 12 be subject to a relative movement to cut the product string 12 with the laser beam 15 by means of a cutting movement, e.g. with the relative movement provided by a movement of the dosage container 10 and filling pipe 11 along a circular track on which a large number of dosage container and filling pipe arrays are moved.

While there has been shown and described what are at present considered the preferred embodiment of the invention, it will be obvious to those skilled in the art that various changes and modifications can be made therein without departing from the scope of the invention defined by the appended claims.

I claim:

1. A decanting system for product made of viscous material discharged in the form of a product string (12) in a product discharge direction from a portioning device (10, 11), said system comprising:

a laser which emits laser beam (15) directed transversely to the product discharge direction and passes through the product string (12) to cut said product string (12) into portions, wherein at least one of the laser beam (15) and product string (12) are movable in a direction transverse to the product discharge direction relative to the other of the laser beam (15) and product string (12) in order for the laser beam (15) to cut through the product string (12) from one side of the product string (12) to an opposite side of the product string (12).

2. The decanting system as in claim 1, including a device for moving at least one of the laser beam (15) and product string (12) relative to the other of the laser beam (15) and product string (12), in order to cut through the product string (12) from one side to the opposite side.

3. The decanting system as in claim 2, characterized in that the laser beam (15) is stationary and continuously emitted, and that the product string (12) is moved transversely through the laser beam (15).

4. The decanting system as in claim 1, characterized in that the laser beam (15) is discontinuously directed at the product string (12) in order to cut through the product string (12).

5. The decanting system as in claim 1, in which the energy density of the laser beam (15) and its contact time with the product string (12) are adjusted based upon the material and strength of the product string (12) such that the product string (12) is cut through without creating at least one of threads, subsequent droplets formation, and jagged cut portions.

6. The decanting system as in claim 1, in which the laser generating the laser beam (15) is a $CO_2$ laser.

7. A method of using a decanting system for product made of viscous material discharged from a portioning device (10, 11) in the form of a product string (12) portions, said method comprising:

discharging the product string in a product discharge direction from the portioning device;

cutting through the product string using a laser beam (15), wherein said laser beam (15) is directed transversely to the product discharge direction and passes through the product string (12);

moving at least one of said product string and said laser beam transverse to the product discharge direction to cut the product string into portions; and discharging said portions into a container (13).

8. A method of using a decanting system for product made of viscous material discharged from a portioning device (10, 11) in the form of a product string (12), said method comprising:

cutting through the product string using a laser beam (15), wherein said laser beam (15) is directed transversely to the product discharge direction and passes through the product string (12) to cut the product string into portions; and discharging said portions into a container (13), in which the viscous material is an adhesive, and the adhesive is discharged into the container (13) in liquid form.

9. The method as in claim 8, in which the adhesive is a watery/easily flowing to moderately viscous substance.

10. The method as in claim 8, in which the adhesive is a highly viscous substance with a semi-solid consistency.

* * * * *

UNITED STATES PATENT AND TRADEMARK OFFICE

CERTIFICATE OF CORRECTION

PATENT NO. : 6,891,125 B2
DATED : May 10, 2005
INVENTOR(S) : Muhlenbach

It is certified that error appears in the above-identified patent and that said Letters Patent is hereby corrected as shown below:

Title page,
Item [57], ABSTRACT,
Line 3, “deuce” should be -- device --.

Signed and Sealed this

Twentieth Day of September, 2005

JON W. DUDAS
*Director of the United States Patent and Trademark Office*